US007444688B2

(12) United States Patent
Sublett

(10) Patent No.: US 7,444,688 B2
(45) Date of Patent: Nov. 4, 2008

(54) SYSTEM AND METHOD FOR HANDLING FLEXIBLE STRAPS IN A HIGHLY ADJUSTABLE QUIVER APPARATUS

(76) Inventor: Bryan A. Sublett, 3101 Shoreline Dr., Apt. #1211, Austin, TX (US) 78728

( * ) Notice: Subject to any disclaimer, the term of this patent is extended or adjusted under 35 U.S.C. 154(b) by 431 days.

(21) Appl. No.: 10/835,981

(22) Filed: Apr. 30, 2004

(65) Prior Publication Data

US 2004/0221359 A1 Nov. 11, 2004

Related U.S. Application Data

(60) Provisional application No. 60/491,105, filed on Jul. 29, 2003, provisional application No. 60/480,282, filed on Jun. 20, 2003, provisional application No. 60/467,870, filed on May 5, 2003.

(51) Int. Cl.
*A41F 19/00* (2006.01)

(52) U.S. Cl. ..... 2/310

(58) Field of Classification Search ..... 2/459, 2/44, 45, 267, 268, 69, 310, 326–328, 247, 2/94; 224/679, 264, 265, 201, 682
See application file for complete search history.

(56) References Cited

U.S. PATENT DOCUMENTS 2,508,190 A * 5/1950 Previdi ..... 2/253
4,119,248 A * 10/1978 Butler et al. ..... 224/148.3
4,555,812 A * 12/1985 Akers ..... 2/94
4,815,640 A * 3/1989 Johnson ..... 224/601
4,878,606 A 11/1989 Miller
4,974,761 A * 12/1990 Luque ..... 224/148.6
5,150,824 A * 9/1992 Alvarez et al. ..... 224/586
5,337,933 A 8/1994 Nunez
5,718,364 A 2/1998 McDowell
6,079,055 A * 6/2000 Mencel ..... 2/459
6,092,702 A * 7/2000 Cassidy, IV ..... 224/153
6,119,907 A 9/2000 Benjamin
6,170,959 B1 * 1/2001 Richardson, III ..... 362/103
6,182,874 B1 * 2/2001 Feldman, Jr. ..... 224/259
6,343,728 B1 2/2002 Carbone
6,349,411 B1 * 2/2002 Tyler ..... 2/69
6,405,912 B2 6/2002 Giannou
6,474,523 B2 11/2002 Morrison et al.
2003/0006261 A1 1/2003 Morrison et al.

* cited by examiner

*Primary Examiner*—Tejash Patel
(74) *Attorney, Agent, or Firm*—Bracewell & Giuliani LLP

(57) ABSTRACT

A system and method for handling flexible straps, such as ductwork straps, utilizes a highly adaptable quiver-type harness. The harness has an elongated sleeve that is designed to receive and accommodate the flexible straps, and is designed to be worn by a user in one of two different and reversible positions. The harness may be worn around the waist of the user, or over one shoulder of the user in a traditional quiver-like position. The harness has a completely adjustable body strap that configures the harness in either the waist position or the quiver position.

1 Claim, 4 Drawing Sheets

SYSTEM AND METHOD FOR HANDLING FLEXIBLE STRAPS IN A HIGHLY ADJUSTABLE QUIVER APPARATUS

The present utility patent application is based on and claims the benefit of the following three provisional patent applications: U.S. Provisional Patent Application No. 60/467,870, filed May 5, 2003; U.S. Provisional Patent Application No. 60/480,282, filed Jun. 20, 2003; and U.S. Provisional Patent Application No. 60/491,105, filed Jul. 29, 2003, each of which is incorporated herein by reference.

BACKGROUND OF THE INVENTION

1. Technical Field

The present invention relates in general to an improved device for handling flexible straps and, in particular, to an improved system and method for handling and manipulating flexible straps in a highly adjustable quiver-type apparatus.

2. Description of the Related Art

Flexible straps or "zip ties" are useful for many different applications including quickly and easily securing objects to one another. Most flexible straps are formed from an inexpensive nylon plastic material as long, thin, flat straps. One end of the strap has a small buckle-type receiver for receiving an opposite flat tongue-like end of the strap. The strap forms a loop when the tongue is inserted into the buckle. One of the surfaces of the strap is provided with "teeth" that engage the buckle when inserted therein. The teeth permit the strap to proceed through the buckle in only one direction. The loop becomes smaller and, thus, tighter as the tongue is inserted further into the buckle, thereby binding together any objects located inside the loop. Typically, the loop must be cut or severed to remove the strap from the bound objects, which limits the strap to a single use.

Flexible straps are manufactured in many different sizes depending upon the application for which they are intended. For example, in the heating, ventilation, and air conditioning (HVAC) industry, flexible duct straps are used extensively in large numbers to install flexible air ductwork. Duct straps are usually provided in lengths of either 36 and 48 inches, and packaged in clear plastic bags in quantities of 50. In the prior art, ductwork installers either inefficiently hand-carry a few of the duct straps, or tape an entire bag to a ladder used in the installation process. Ladder-mounting the bags is also inefficient in that the installer must constantly go up and down the ladder to retrieve additional duct straps.

A third mode of transporting duct straps used by commercial installers is to insert the duct straps through the belt loops on the pants of the installer. Since the duct straps are flexible, they wrap around the waist of the installer and are loosely held in place by his or her belt loops. However, the belt loops provide very limited space for approximately 10 duct straps, thereby requiring the installers to almost constantly refill their belt loops.

Flexible straps are provided in many other sizes as well, including common lengths of 8 inches and 12 inches, for many industrial and commercial applications. Like the duct work installers, installers of these smaller flexible straps typically hand-carry a bag of the flexible straps. Alternatively, they may place them in a pants pocket or tool bag, or wrap and tighten one of the straps around the bundle of the other straps. With the latter handling mode, the one outer strap must be repeatedly re-tightened around the bundle of straps as the straps are used up. Although each of the strap handling modes is workable, an improved solution for handling flexible straps would be highly desirable over and more efficient than these prior art methods.

SUMMARY OF THE INVENTION

One embodiment of a system and method for handling flexible straps utilizes a highly adaptable quiver-type harness apparatus. The harness has an elongated sleeve that is designed to receive and accommodate flexible straps of various sizes, but is particularly well adapted to handle duct straps having lengths of 36 inches or 48 inches. The harness is designed to be worn by a user in one of two different and reversible positions to accommodate the users specific needs at any time.

In one embodiment, the harness has a capacity of about 75 duct straps and is formed from a material such as Cordura 600 Denier. The harness may be worn around the waist of the user, or over one shoulder of the user in a traditional quiver-like position. The harness has a completely adjustable body strap that configures the harness in either the waist position or the quiver position. When the harness is in one of the two positions on the user it should fit snugly and yet comfortably to provide ease and convenience of use. The harness is easy to put on, take off, and adjust, and provides the flexible straps readily at hand.

It is the length of the body strap and the flexibility of the harness that adjusts the harness to be worn around the waist or over the shoulder in the quiver position. The body strap may be formed from a lightweight polypropylene material, and is attached (e.g., sewn) to the length of the sleeve. The thread used to sew the body strap to the sleeve may be, for example, 69-bonded continuous filament thread.

The body strap has a fastener, such as a nylon side release buckle, for releasably securing the harness to the user. Typically, the male end of the buckle is adjustable and the female end of the buckle is not adjustable. The body strap goes through the female end of the buckle and is sewn back to itself and the harness. The male end of the buckle is on a length (e.g., a 32-inch length) of the body strap and extends from the open end of the sleeve. A small portion of the body strap is folded and sewn back to itself to prevent the male end of the buckle from detaching.

The harness further comprises a releasable fold-over flap that an overall length of about two inches. A pair of snap buttons, such as black oxide snaps, releasably secure the flap to the sleeve. The flap is unsnapped from the sleeve when wearing the harness around the waist in order to allow the flexible straps located in the sleeve to be evenly adjusted around the waist of the user. The snaps on the flap are in snapped onto the sleeve when wearing the harness over the shoulder in the quiver position to prevent the duct straps from falling out of the lower end of the sleeve. In the folded and snapped-closed position, the flap is about one inch in linear length (relative to the sleeve) and ensures that the flexible straps are retained in the harness.

An opposite end of the sleeve is open (i.e., has no flap) for readily inserting additional flexible straps. Each of the open end and the flap end of the sleeve have a reinforcement strap (e.g., one-inch wide poly strap, like the body strap) sewn around the sleeve to prevent the body strap from tearing apart from the sleeve. The reinforcement straps are oriented in a perpendicular configuration with respect to the body strap.

In another embodiment, the harness is designed to accommodate much smaller flexible straps, such as those of the 8-inch and 12-inch variety (i.e., "zip ties"), or both. Each type of flexible strap is provided with its own sleeve that is appropriately sized to contain a large quantity (e.g., approximately 100) of the flexible straps. The two sleeves can either be worn together on the user, separately on the user, or attached as an auxiliary component to the previously described embodiment, depending on the user's desire.

These smaller sleeves are designed to retain the flexible straps even if the sleeves are inverted upside down during use. Each sleeve has an elastic cord at an upper end. The elastic cord extends through a chase sewn in the upper end. There is an open area in the front of the sleeves for both ends of the elastic cord to exit and run through a cord stop. The elastic cord and the cord stop work together in a manner of ensuring that the flexible straps stay in the sleeves regardless of the quantity of flexible straps contained by the sleeves. As the installer uses the flexible straps and the sleeves are emptied, the installer simply holds and depresses the cord stop and pulls on the cord until the desired tightness is achieved. In doing this, the elastic cord is tightened around the flexible straps in the sleeve and will stay tight while removing the flexible straps due to the elastic cord being stretched when pulled tight. This function serves to keep the flexible straps in the sleeves as work is being performed. The elastic band is of a very durable elastic type and designed to handle repetitive use.

One embodiment of the sleeve is approximately 10 inches in length (for 12-inch straps) and 1.5 inches in diameter. The male and female ends of the belt clip assembly (e.g., snap buttons) are reinforced to assure the durability of the harness. This embodiment of the harness may be formed from many different types of material including, for example, Polyester 600. Again, the harness may be worn directly on the waist of the user with the belt clip assembly, and the two sleeves of the harness (e.g., for 8-inch straps and 12-inch straps) are releasably fastened together with snap buttons if the user desires to wear both sleeves together at the same time. Moreover, the sleeves may be worn individually by the user as well.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
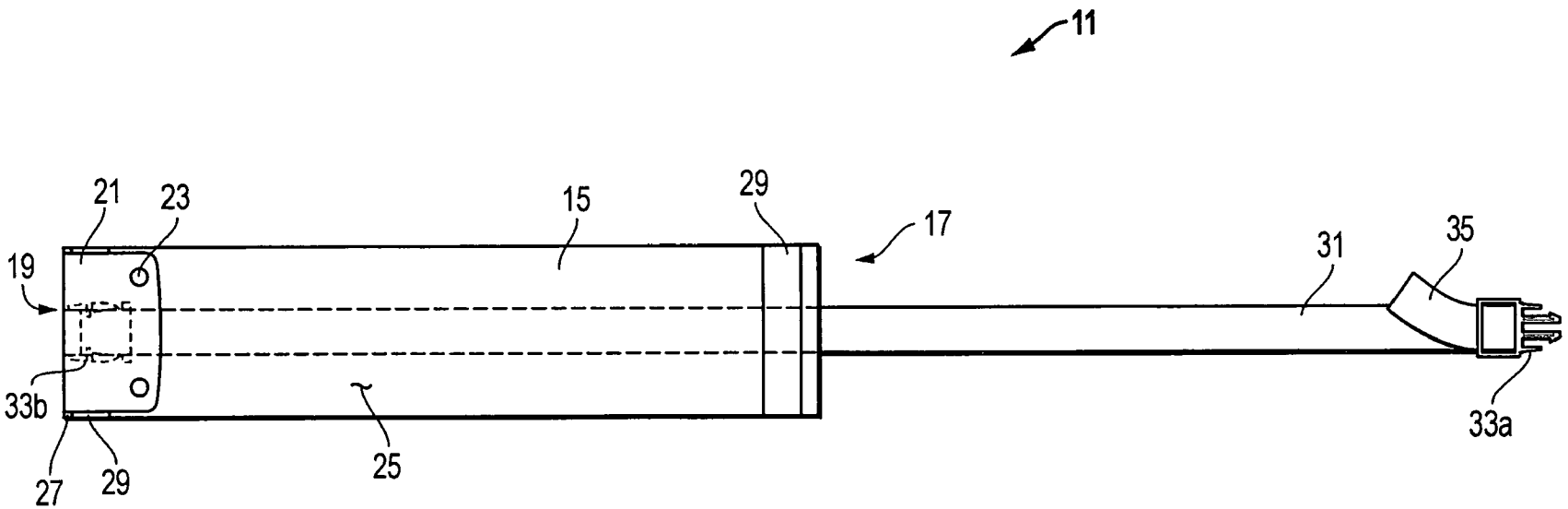
FIG. 1 is a front view of a harness constructed in accordance with the present invention.
Figure 2:
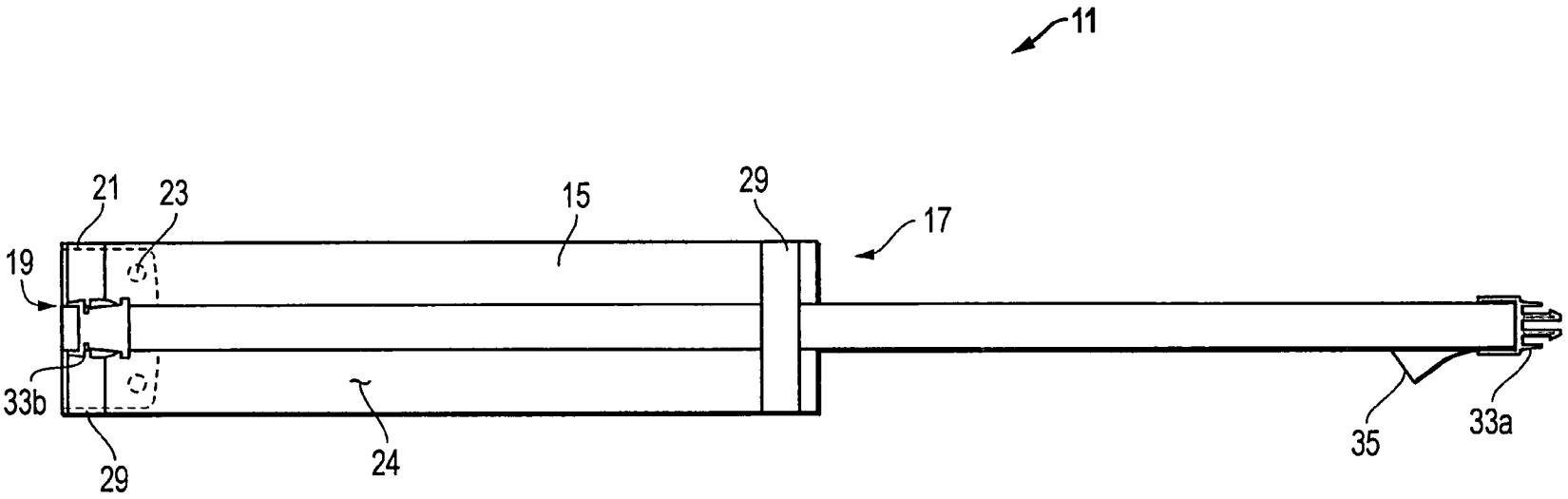
FIG. 2 is a rear view of the harness of FIG. 1.
Figure 3:
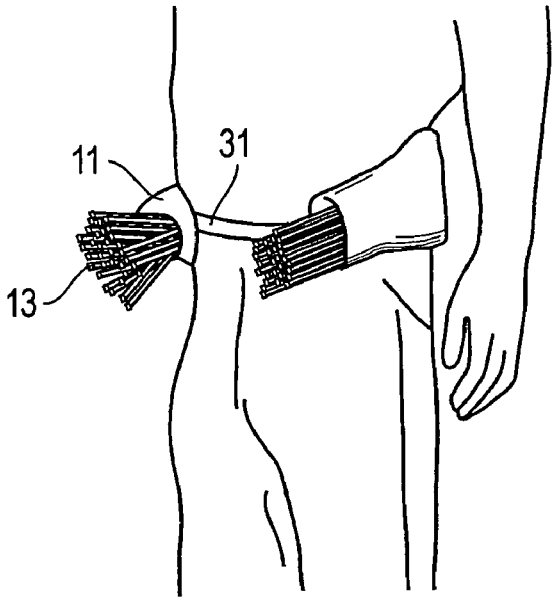
FIG. 3 is a front isometric view of the harness of FIG. 1 shown in a waist position on a user.
Figure 4:
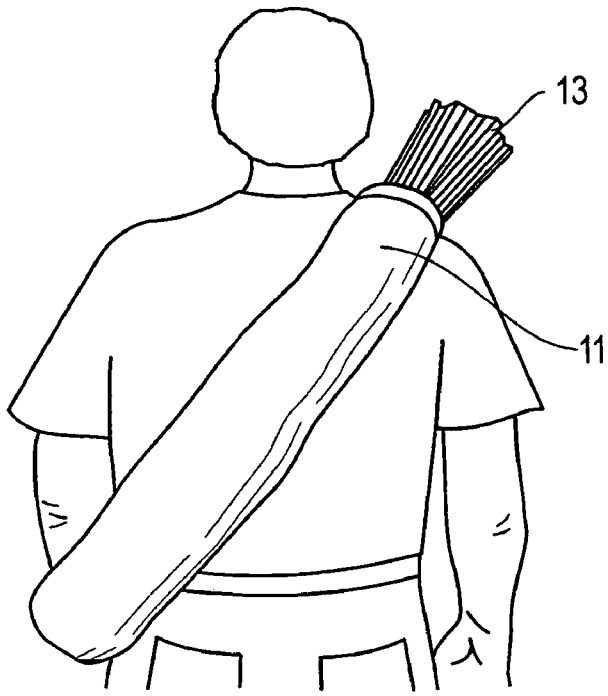
FIG. 4 is a rear isometric view of the harness of FIG. 1 shown in a quiver position on a user.

Referring to FIGS. 1-4, one embodiment of a system and harness 11 for facilitating the handling and support of flexible straps 13 on the body of a user is shown. In the embodiment shown, the harness 11 comprises a flat, flexible, hollow tubular sleeve 15 having an interior, an open end 17, and a closable end 19 located opposite the open end 17. The sleeve 15 and, more particularly, the open end 17 is adapted to receive and retain the flexible straps 13 (FIG. 3 and 4) in the interior thereof.

The closable end 19 includes a foldable flap 21 having an open position (FIG. 3) for providing access to the interior, and a closed position (FIG. 4) for preventing access to the interior. The flap 21 and sleeve 15 use snaps 23 to retain the flap 21 in the closed position. The flap 21 is located on an exterior surface 25 of the sleeve 15. A small portion 27 of the sleeve 15 (between a retention strap 29 and the flap 21) folds over with the flap 21 when the flap 21 is in closed position to provide better retention of the flexible straps 13.

A flexible, adjustable body strap 31 is mounted to the sleeve 15 for securing the sleeve 15 to the body of the user. The body strap 31 has a fastener 33 for attaching and releasing the body strap 31 relative to the user. In the embodiment shown, the fastener 33 comprises a buckle having a male end 33*a* and a complementary female end 33*b*. The fastener 33 is adjustable in that an extra portion 35 of the body strap 31 may be inserted through or withdrawn from the male end 33*a* in order to adjust a length of the body strap 31.

Referring again to FIGS. 3 and 4, the harness 11 has a waist position such that the body strap 31 is configured to support the sleeve 15 around the waist of the user, and a quiver position such that the body strap 31 is configured to support the sleeve 15 over a shoulder and across a back of the user. In the waist position, the flexible straps 13 extend from both the open end 17 and the closable end 19 of the sleeve 15. In the quiver position, the flexible straps 13 extend from only the open end 17 of the sleeve 15.

As alluded to earlier, the body strap 31 has a reinforcement strap 29 located adjacent to each of the open and closable ends 17, 19. In the embodiment shown, the reinforcement straps 29 circumscribe the sleeve 15 (i.e., both the inner and outer surfaces 24, 25) and reinforce retention of the body strap 31 on the sleeve 15. The body strap 31 is preferably sewn across substantially an entire length of the inner surface 24 of the sleeve 15, as shown.

Figure 5:
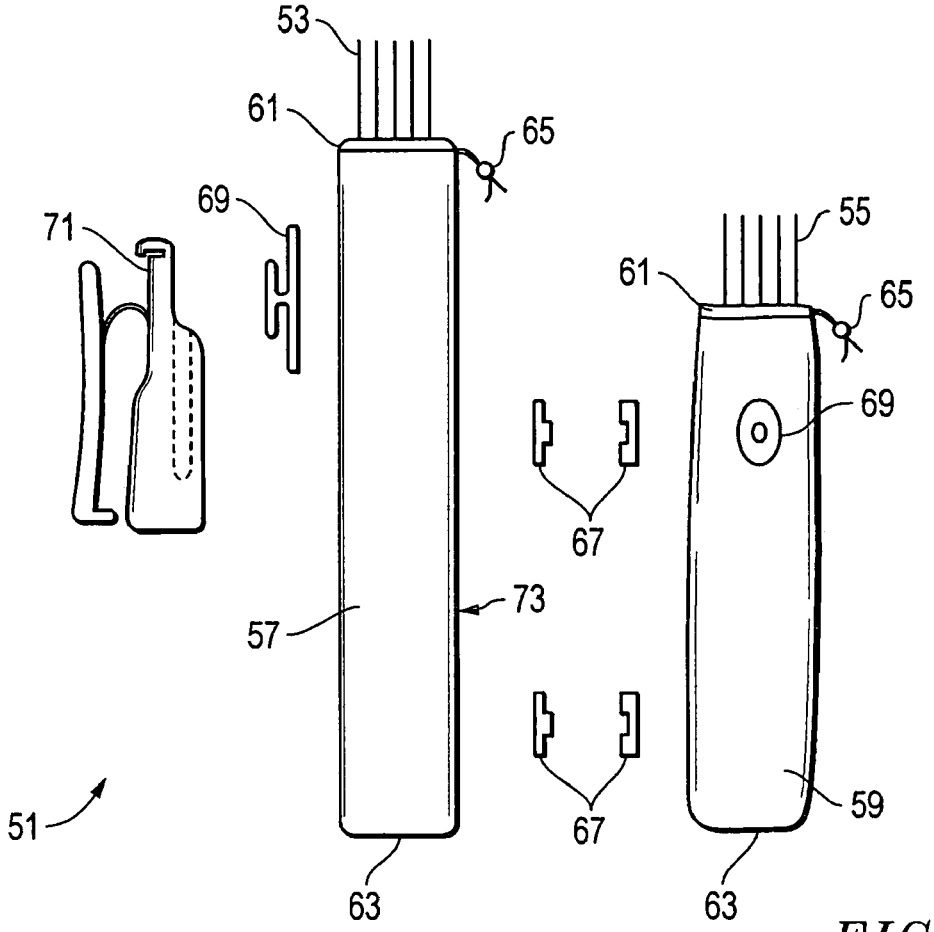
FIG. 5 is an exploded side view of an alternate embodiment of a harness constructed in accordance with the present invention.
Figure 6:
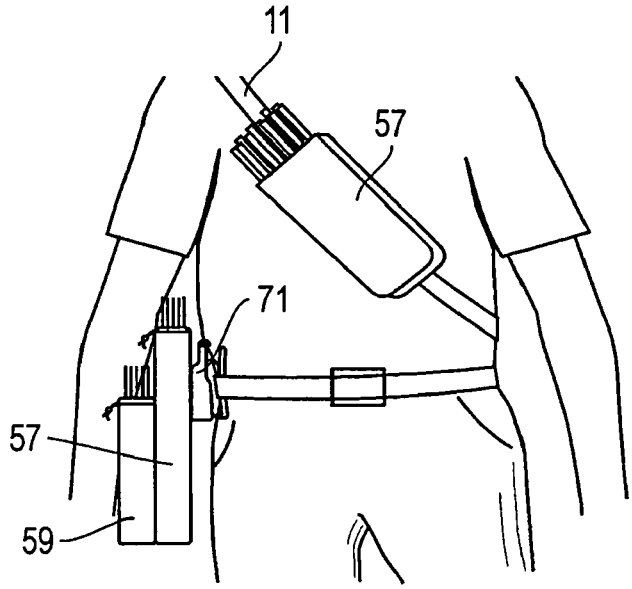
FIG. 6 is a front isometric view of the harness of FIG. 5 shown on a user and as an attachment on the harness of FIG. 1.

Referring now to FIGS. 5 and 6, a second embodiment of a harness 51 constructed in accordance with the present invention is shown. Similar to harness 11, harness 51 also comprises a system for retaining flexible straps 53, 55 on the body of a user in a segmentable form. The harness 51 comprises first and second pouches 57, 59, that differ in size according to the type and size of the flexible strap 53, 55, respectively, they are designed to house.

Each pouch 57, 59 has an interior (i.e., a pocket), an open end 61 for providing access to the interior, a closed end 63 opposite the open end 61, an elastic draw string or cord and cord stop 65 for adjusting a size of an opening of the open end 61, an exterior, and fasteners 67 (e.g., snaps) and mounting hardware 69 on the exterior. The system also comprises separate mounting hardware 71 that is attachable to the user for engaging and retaining the mounting hardware 69 on at least one of the first and second pouches 57, 59. The first and second pouches 57, 59 are mountable to the user via the mounting hardware 69, 71, and the second pouch 59 is mountable to the first pouch 57 via the fasteners 67.

In the embodiment shown, the first pouch 57 is mounted to the user and the second pouch 59 is mounted to a distal surface 73 of the first pouch 57 that is spaced apart from the user. This embodiment further comprises a sling 11 (see, e.g., harness 11) having a waist position (FIG. 3) that is located about the waist of the user, and a quiver position (FIGS. 4 and 6) that is located over a shoulder and across a back of the user. One of or both pouches 57, 59 may be secured directly to the sling 11 rather than to the user.

While the invention has been shown or described in only some of its forms, it should be apparent to those skilled in the art that it is not so limited, but is susceptible to various changes without departing from the scope of the invention.

What is claimed is:

1. A harness for retaining flexible straps on a body of a user, comprising:

first and second pouches, each having an interior, an open end for providing access to the interior, a closed end opposite the open end, an elastic draw string for adjusting a size of an opening of the open end, and an exterior;

mounting hardware that is adapted to be attached to the user for engaging and retaining at least one of the first and second pouches;

the first and second pouches are each adapted to be mounted to the user via the mounting hardware, and the second pouch is mounted to a distal, outer surface of the first pouch that is located opposite to and spaced apart from the user; and a sling having a waist position that is adapted to be located about the waist of the user, and a quiver position that is adapted to be located over a shoulder and across a back of the user;

the first pouch is secured directly to an outer surface the sling rather than to the user, and the second pouch is mounted directly to an exterior of the first pouch opposite the sling rather than directly to the user, the second pouch being detachably removable from the first pouch via the mounting hardware; and each of the elastic draw strings has a cord stop for adjusting a length of the elastic draw strings.

* * * * *